United States Patent [19]

Yung

[11] Patent Number: 4,721,480

[45] Date of Patent: Jan. 26, 1988

[54] DETACHABLE CEILING FAN SWITCH UNIT

[75] Inventor: Yau Yung, Hong Kong, Hong Kong

[73] Assignee: Shell Electric Mfg. (Holdings) Co., Ltd., Hong Kong, Hong Kong

[21] Appl. No.: 761,159

[22] Filed: Aug. 1, 1985

[51] Int. Cl.[4] ..... H01R 13/60; H01R 13/66

[52] U.S. Cl. ..... 439/527; 416/5

[58] Field of Search ..... 339/122 R, 122 F, 135; 416/146 R, 5, 244 R; 417/424; 415/121 G; 310/40.5; 200/299, 298, 303; 439/535, 536, 527

[56] References Cited

U.S. PATENT DOCUMENTS 4,518,314 5/1985 Schultz ..... 416/5 X
4,637,673 1/1987 Yang ..... 339/135 X

FOREIGN PATENT DOCUMENTS 7122733 5/1971 Taiwan .
1208928 10/1970 United Kingdom ..... 416/5

*Primary Examiner*—Eugene F. Desmond
*Attorney, Agent, or Firm*—Sheldon & Mak

[57] ABSTRACT

A switch unit for a ceiling fan contains electrical wiring which connects the switch gear to the motor and the electrical power supply. The switch unit is readily detachable from the motor housing due to the respective unitary electrical connectors which connect the wiring at that point. The housing for the switch unit contains ventilating apertures to allow the flow of cooling air through the unit.

9 Claims, 5 Drawing Figures

DETACHABLE CEILING FAN SWITCH UNIT

BACKGROUND OF THE INVENTION

The field of this invention is ceiling fan assemblies, and more particularly the switch unit used in ceiling fan assemblies.

Ceiling fan assemblies are often mounted in the place of existing light fittings. A ceiling fan assembly typically comprises a motor housing which is suspended from the ceiling and carries the fan blades, a switch unit which contains a switch-gear for controlling the operation of the motor, and a light fitting. The electrical connections between the motor housing and the switch unit are made by the manufacturer in a relatively permanently interconnected fashion. The apparatus is then supplied to the retailer or user with the motor housing and the switch unit already secured together and, thus, not readily disconnectible due to the nature of the electrical connections between them.

Such an assembly poses a number of disadvantages for the manufacturer or for anyone servicing the switch unit of an already-mounted ceiling fan or attempting to add or remove the light fitting of an already-mounted ceiling fan.

The fact that the electrical connections between the motor housing and the switch unit are relatively permanently interconnected prevents the switch unit from being worked on as an individual component on an assembly line, at certain stages of its manufacture, when such a technique would otherwise be desirable. For example, a worker on a production line who assembles the switch housing must manipulate the heavy motor housing at the same time. Additionally, the overall shape of the assembled motor housing and switch unit wastes space in packing and storing, thereby adding considerably to the end cost of the product.

Once the ceiling fan is mounted, an individual who wishes to service the parts inside the switch housing is forced to remove the bottom portion of the switch housing and look directly up into the interior of the housing. The individual must then work in this posture, which is particularly tiring and inconvenient. An alternative approach would be to remove the entire apparatus from the ceiling in order to service the switch unit (remembering that the motor housing and the switch unit are not designed to be readily disconnectible); however, such an alternative is clearly undesirable If a light fitting is to be added to or removed from an already-mounted ceiling fan, the individual doing the work encounters the above-described problems in connecting or disconnecting the relevant wiring. Further, it is necessary for someone to support the weight of the light fitting at the same time, thereby, likely requiring the assistance of an additional person in the operation. Finally, adding or removing a light fitting from an already-mounted ceiling fan exposes the individual doing the work to some chance of electrical shock due to his proximity to the power source.

Additionally, an incandescent light fitting dissipates over 80% of its consumed power in the form of heat. The area just beneath the fan motor is the "eye" of the air flow vortex, similar to the eye of a typhoon or hurricane. There is very little air movement in that region, creating a potential heat build-up problem. Heat from the light fitting puts stress on the capacitor inside the switch unit which forces manufacturers to use a more expensive capacitor with a greater temperature resistance.

SUMMARY OF THE INVENTION

A switch unit for a ceiling fan comprises a housing including an upper housing part securable to a motor housing and having, or being adapted to receive, first wiring means for connection to said motor and to an electrical power supply. The housing also includes a lower housing part which contains the switch-gear for the motor and is readily removable from and connectible to said upper housing part by a user. Said lower housing part contains a second wiring means for connecting said switch-gear to the motor and the electrical power supply, said second wiring means being adapted to be readily connectible to and disconnectible from said first wiring means by a user.

In a preferred embodiment, said first and second wiring means terminate in respective unitary electrical connectors, as in the form of at least one plug and socket respectively for ready interconnection and disconnection.

Thus, firstly the lower housing part containing the switch-gear may readily be removed from the upper housing part, for example by first undoing just a few screws and then readily disconnecting said first and second wiring means, so as to enable the switch-gear in the lower housing part to be serviced at ground level, e.g. on a table. Secondly, with the lower housing unit so disconnected, a light fitting may readily be connected to or disconnected therefrom, a procedure which alleviates electrical hazards due to the removal of the lower housing unit from the power source. Thirdly, as the upper and lower housing parts of the switch unit are readily interconnectible and disconnectible by a user, the lower housing part containing the switch-gear may be worked upon as an individual component by the manufacturer at a later stage in production than has hitherto been possible. Such detachability also allows manufacturers to assemble the motor housing and the switch unit on two separate production lines simultaneously and, thereby, to greatly increase production without necessarily increasing the work force. The lower housing part can then be packed in a rectangular carton together with but separated from the already interconnected motor housing and upper housing part in a side by side relationship, with the lower housing part occupying a corner region of the carton which would otherwise be wasted space, and the necessary height of the carton thereby reduced so as to save on storage space and transportation cost. Finally, different types of detachable switch units can be installed at a user's option, e.g., infrared remote control switch units; an electronic wall switch can be used in which the control signals are passed along the power lines with the switch housing containing electronics to decode those signals.

In a preferred embodiment, said lower housing part contains a ring of ventilating apertures to allow the flow of cooling air up through the switch unit to exit through another ring of apertures in the top wall of said upper housing. As the top surface of the upper housing is never seen by a user, it is not necessary for it to be plated; it can simply be painted for protection against corrosion, a process which is much cheaper than plating, or it can be treated with any other low cost finish. Further, the advantage of a cup-shaped one-piece lower housing part is that it eliminates one assembly step, i.e., putting an additional set of screws, and it prevents the problem of color mismatch between the lower housing part and the upper housing part.

DETAILED DESCRIPTION OF THE INVENTION

Figure 1:
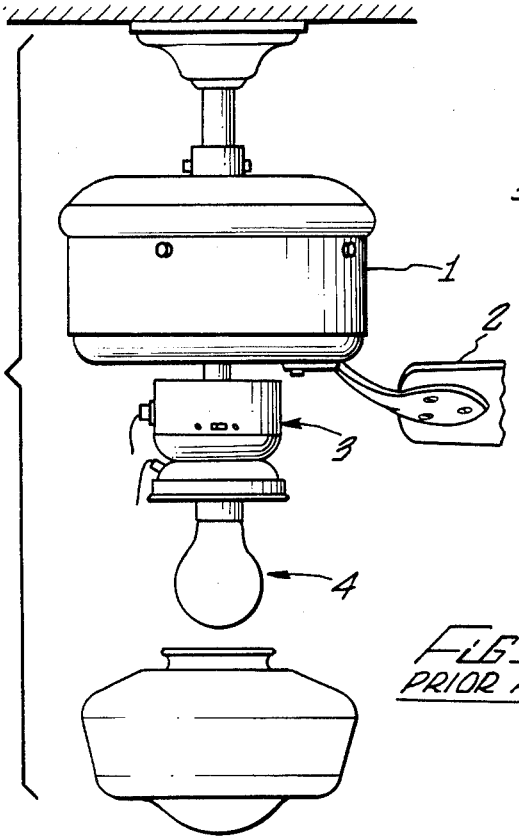
FIG. 1 PRIOR ART
FIG. 1 is a side view of a conventional ceiling fan assembly.
Figure 2:
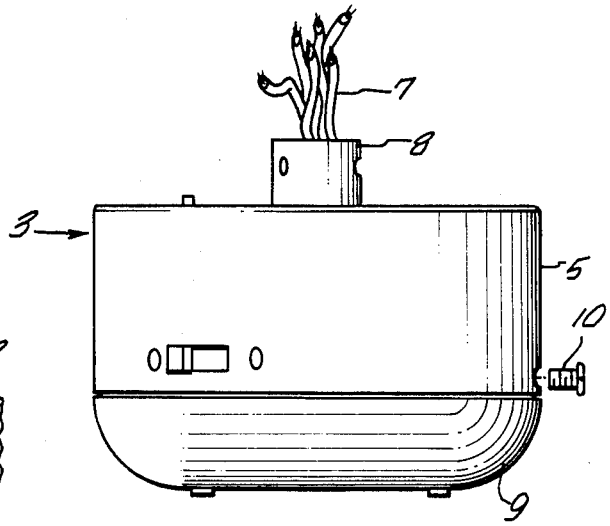
FIG. 2 PRIOR ART
FIG. 2 is a side view of a switch unit of the apparatus in FIG. 1.
Figure 3:
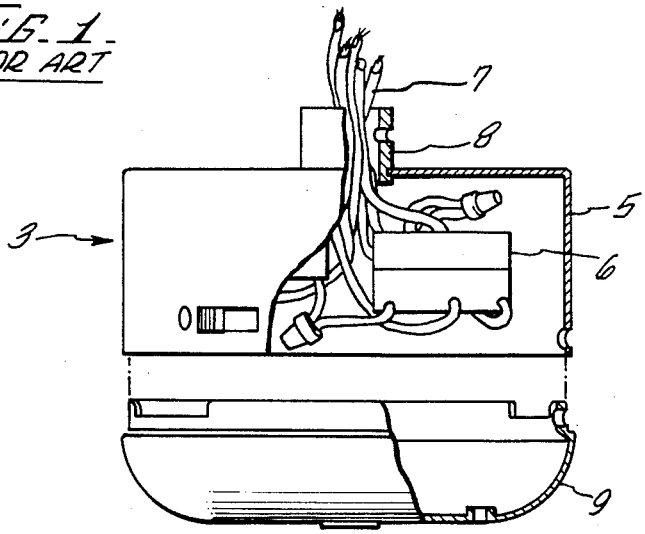
FIG. 3 PRIOR ART
FIG. 3 shows the switch unit of FIG. 2 with its upper and lower housing parts separated and with parts broken away to show the interior.

As shown in FIGS. 1 through 3, a ceiling fan comprises a motor housing 1 which is suspended from the ceiling and carries the fan blades 2 (of which only one is shown), a switch unit 3 which contains switch-gear for controlling the operation of the motor, and a light fitting 4.

Referring particularly to FIGS. 2 and 3, the switch unit typically comprises an upper housing part in the form of a one-piece inverted cup-shaped body 5 containing switch-gear 6 from which a number of electric wires 7 extend upwardly through a hollow boss 8 located centrally of the integral roof of the housing body 5 for connection to the motor and to the electrical power supply. A bottom closure 9 of the switch unit 3 is detachably secured to the upper housing body 5 by mean of at least one set-screw 10, to permit access to the interior of the unit when the switch-gear 6 needs servicing or when the light fitting is to be connected or disconnected to or from the unit 3.

Figure 5:
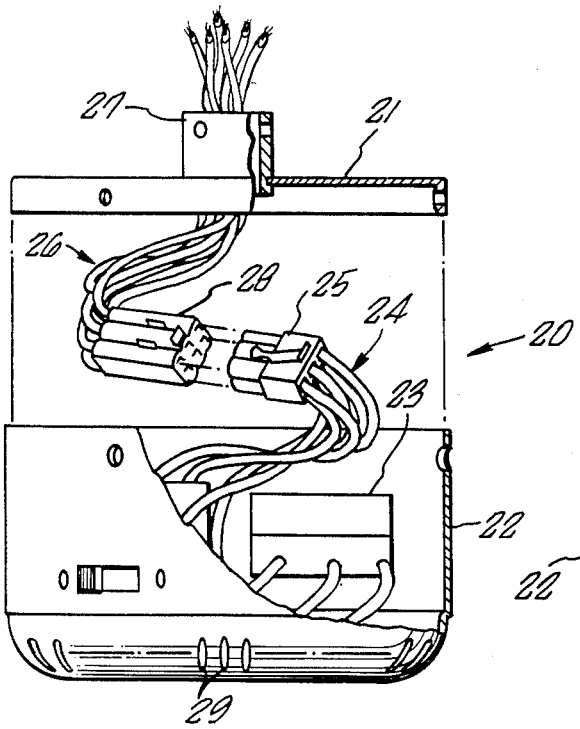
FIG. 5 is a view similar to FIG. 3 but shows an embodiment of the invention.
Figure 4:
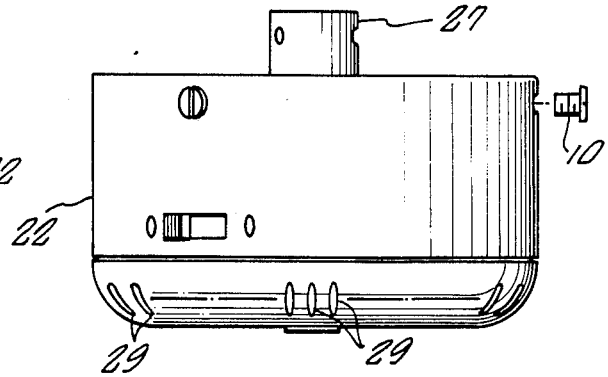
FIG. 4 is a side view of an embodiment of the invention.

Referring next to FIGS. 4 and 5, the illustrated switch unit 20 according to the present invention comprises upper and lower housing parts 21 and 22, respectively, which are connectible to a motor housing 1 and light fitting 4 in the same manner as in the apparatus of FIGS. 1 to 3. The manner in which switch-gear 23 of the switch unit is connected to the motor and the electrical power supply is however quite different, as described below.

The switch gear 23 is mounted in the lower housing 22, which is substantially cup-shaped, and wiring means 24 for connecting the switch-gear to the motor and to the electrical power supply terminate in at least one unitary electrical plug 25. The upper housing part 21, which takes the form of a lid for the cup-shaped lower housing part 22, has wiring means 26 for connection to the motor and power supply extending through a central hollow boss 27 thereof and terminating in at least one unitary electrical socket 28. The plug 25 and socket 28 are of course readily connectible and disconnectible, as are the upper and lower housing parts 21 and 22, with the advantages already explained herein.

The lower housing part 22 is formed with a ring of radially extending stamped recesses 29, defining ventilating slits 30 at their radial sides, for the flow of cooling air up through the switch unit to exit through another ring of apertures (not shown) in the top wall of the upper housing part 21.

The preferred embodiments of the invention have been described herein for purposes of example only and should not be construed to limit the scope of the invention beyond those set forth in the appended claims.

We claim:

1. A switch unit for a ceiling fan, comprising a housing including an upper housing part securable to motor housing and being adapted to receive first wiring means for connection to said motor and to an electrical power supply, and a lower housing part which contains the switch-gear for the motor and is readily removable from and connectible to said upper housing part by a user, said lower housing part having second wiring means for connecting said switch-gear to the motor and the electrical power supply, said second wiring means being adapted to be readily connectible to and disconnectible from said first wiring means by a user, wherein said lower housing part is substantially cup-shaped and said upper housing part comprises a substantially flat lid formed with a central hollow boss for the passage of said first wiring means, and such lid interengaging within the cup-shaped lower housing part whereby the lid is unseen by a user, and wherein said lower housing part has at least one ventilating aperture in a base portion thereof for cooling air to flow upwardly into the unit, said second wiring means terminating in at least one first unitary electrical connector, and said upper housing part including said first wiring means, said first wiring means terminating in at least one second unitary electrical connector readily connectible to and disconnectible from said first unitary electrical connector.

2. A switch unit as set forth in claim 1, wherein said first and second electrical connectors comprise a plug and a socket.

3. A switch unit aw set forth in either claim 1 or claim 2, wherein a ring of said ventilating apertures is provided.

4. A switch unit as set forth in claim 3 wherein each of said ventilating apertures comprises a slit arranged at one side of a recess stamped in the said base portion so as not be readily visible from below the unit.

5. A switch unit as set forth in claim 4, wherein said upper and lower housing parts are both substantially circular in plan and are formed with respective substantially circular interengaging surfaces.

6. A switch unit for a ceiling fan, comprising a housing including an upper housing part securable to a motor housing and being adapted to receive first wiring means for connection to said motor and to an electrical power supply, and a lower housing part which contains the switch-gear for the motor and is readily removable from and connectible to said upper housing part by a user, said lower housing part having second wiring means for connecting said switch-gear to the motor and the electrical power supply, said second wiring means being adapted to be readily connectible to and disconnectible from said first wiring means by a user, said second wiring means terminating in at least one first unitary electrical connector, and wherein said first wiring means terminates in at least one second unitary electrical connector readily connectible to and disconnectible from said first unitary electrical connector, wherein said first and second electrical connectors comprise a plug and a socket, said lower housing part having at least one ventilating aperture in a base portion thereof for cooling air to flow upwardly into the unit, wherein said lower hosuing part is substantially cup-shaped and said upper housing part comprises a substantially flat lid formed with a central hollow boss for the passage of said first wiring means, said lower and upper housing parts forming the housing, and the hollow boss being anchored to the motor housing by anchoring means extending transversely towards a shaft for location within the boss.

7. A switch unit as set forth in claim 6, wherein a ring of said ventilating apertures is provided.

8. A switch unit as set forth in claim 7, wherein each of said ventilating apertures comprises a slit arranged at one side of a recess stamped in the said base portion so as not to be readily visible from below the unit.

9. A switch unit as set forth in claim 8, wherein said upper and lower housing parts are both substantially circular in plan and are formed with respective substantially circular interengaging surfaces.

* * * * *